US005402545A

United States Patent [19]

Jolley

[11] Patent Number: 5,402,545

[45] Date of Patent: Apr. 4, 1995

[54] ORTHOPEDIC SEAT CUSHION WITH UPSTANDING PROJECTIONS

[76] Inventor: B. Jeffrey Jolley, 2220 S. Country Club, Suite 102, Mesa, Ariz. 85210-5808

[21] Appl. No.: 223,233

[22] Filed: Apr. 5, 1994

[51] Int. Cl.[6] ..... A47C 7/18

[52] U.S. Cl. ..... 5/653; 297/467

[58] Field of Search ..... 5/653, 654, 900.5, 448; 297/467, 452.26

[56] References Cited

U.S. PATENT DOCUMENTS 3,222,694 12/1965 Schick ..... 5/653
4,951,334 8/1990 Maier ..... 5/653
5,018,790 5/1991 Jay ..... 5/653
5,153,956 10/1992 Nold ..... 5/653
5,294,181 3/1994 Rose et al. ..... 5/653
5,317,773 6/1994 Graebe ..... 5/653

FOREIGN PATENT DOCUMENTS 1271660 9/1961 France ..... 5/653

*Primary Examiner*—Alexander Grosz

[57] ABSTRACT

An orthopedic seat cushion for permitting free circulation and protecting the user's coccyx comprising a unitary body formed of expanded polymeric foam and a skin enclosing said foam is disclosed.

3 Claims, 2 Drawing Sheets

ORTHOPEDIC SEAT CUSHION WITH UPSTANDING PROJECTIONS

BACKGROUND OF THE INVENTION

This invention relates to cushions of the type commonly used by people, including those who suffer from low back pain, poor circulation and/or injured or diseased coccyx and those who simply seek comfort, to add comfort during seating and/or to provide specific support or orthopedic benefits and/or to aid in circulation.

A virtually infinite array of sizes and shapes of cushions may be found. Most are in the traditional "pillory" shape, being either round, square or rectangular in the major configuration and having rounded sides separated by the minor dimension of the cushion. Such cushions do not take into account the comfort or prevention of pain of the user.

Many cushions are also known that are thicker at one edge than at the other to provide greater support to the buttocks than to the upper thigh areas of the user. These cushions provide some comfort but do not promote good circulation and do not protect the coccyx from injury or prevent further injury to the coccyx, nor do they relieve low back pain.

It is the object of this invention to provide a cushion of particular configurations to aid in the circulation of the user and to protect the user's coccyx, especially during long periods of sitting.

SUMMARY OF THE INVENTION

The invention in a particular and preferred embodiment is an orthopedic seat cushion for permitting free circulation and protecting the user's coccyx. The cushion comprises a unitary body formed of expanded polymeric foam and, preferably, a skin enclosing said foam. The body is so shaped, sized and configured as to define a generally rectangular flat bottom cushion surface for resting on and being support by a generally flat support surface front, left, right and rear sides that extend generally perpendicularly upwardly from the bottom cushion surface. The rear sides extends upwardly a distance of at least about one inch greater than the height of the front side such that an upper surface lies generally in a plane above and at an angle of about 5±2 degrees with respect to the bottom cushion surface. The upper surface and the cushion have, as the major dimension thereof, a width of about one and one-fourth to about one and one-half feet and, as the minor dimension thereof, a depth of about one foot. The upper surface is thus configured and adapted to receive and support the buttocks of the user when the user sits thereupon facing toward the front edge thereof.

The generally rectangular, generally planar upper surface is configured to form a multiplicity of upstanding projections extending from said generally planar surface. These projections are preferably spherically segmental in configuration. The respective projections are spaced from each other by distances of from about 1/16th inch to about 1 inch and have a base diameter of from 0.7 to 1.2 inches. They extend from about one-eighth inch to about one-half inch above said generally planar surface.

Left and right ridges extend upwardly from the left end of the planar area and the left end of the rear edge and, respectively, from the right end of the planar surface and from right end of the rear edge. These ridges are generally segmental in cross-section extend from about one-fourth to about one-half inch above the planar area.

A depression is formed in the upper surface in the central rear of the planar area. The depression is preferably generally in the configuration of a segment of a rounded apex frustocone wherein the apex is adjacent the center of the rectangular planar area and the base has a diameter of about two inches defined by the rear edge and rear side of the cushion, the depression being so configured as to receive the coccyx of the user.

A raised general semi-frustoconical portion is generally centrally located in the front edge of the cushion. The front edge of the base of the segment having a diameter of about three inches or greater is defined by the front edge. The raised portion defines a rounded apex extending toward the center of the upper surface.

The foam of which the cushion is formed is compressible to a limited degree such that compression of the cushion while the lower cushion surface is generally uniformly supported on a generally fiat support surface by the application one hundred pounds generally uniformly on the central seating area of the upper cushion surface by not less than one-fourth inch and not more than three-fourth inches; and compression of the cushion while the lower cushion surface is generally uniformly supported on a generally fiat support surface by the application two hundred pounds generally uniformly on the central seating area of the upper cushion surface by not less than one-half inch and not more than one inch.

DESCRIPTION OF THE PREFERRED EMBODIMENTS

The following is a very specific preferred embodiment of the invention and is provided to assist in understanding the invention. It should be understood that the invention conceives of variations as to various features as described below.

Figure 1:
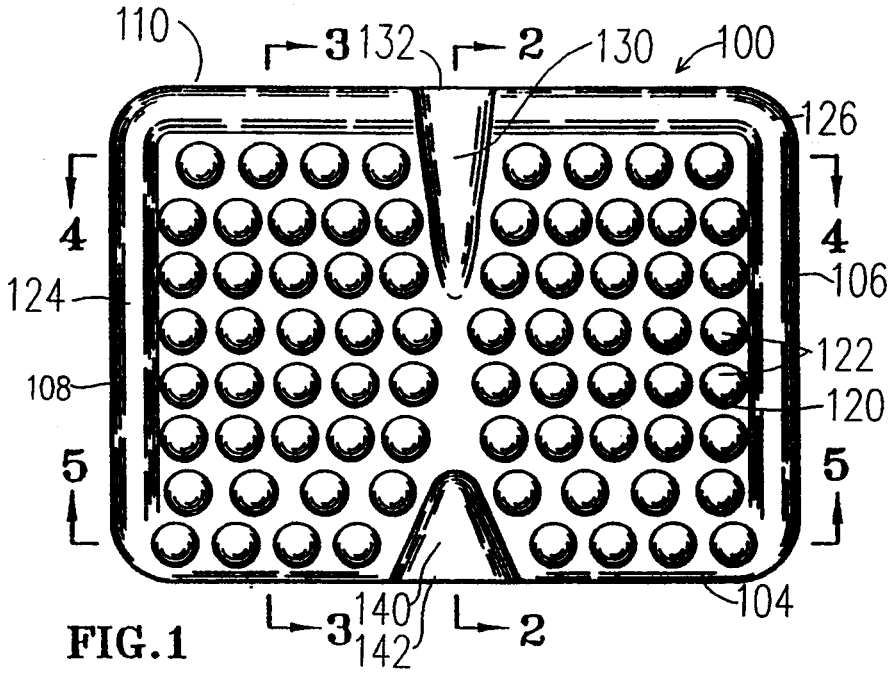
FIG. 1 is a top plan view of the cushion of this invention.
Figure 2:
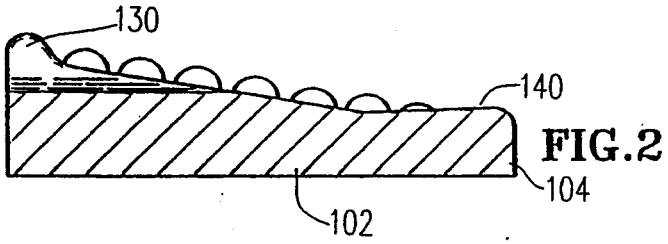
FIG. 2, 3, 4 and 5 are cross-sectional views of the cushion depicted in FIG. 1 taken, respectively, at lines 2—2, 3—3, 4—4, and 5—5 in the direction of the arrows as shown in FIG. 1.
Figure 3:
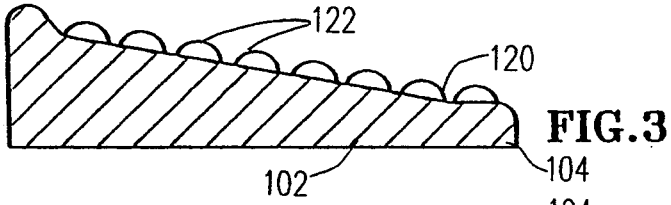
Figure 4:
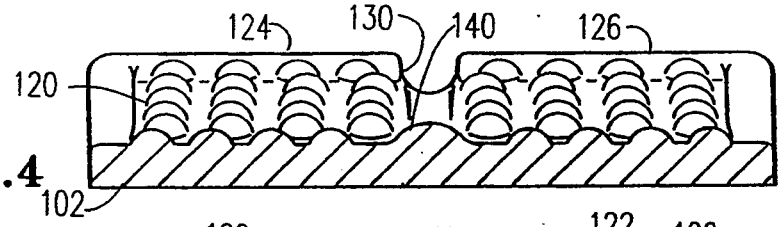
Figure 5:
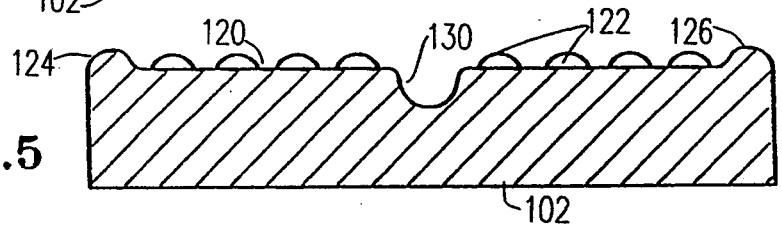

Making reference first to FIG. 1, the orthopedic seat cushion 100 is specifically designed to provide structures for permitting free circulation in the buttocks and legs of the user, for protecting the user's coccyx, providing specific support to reduce or eliminate low back pain, and to foster better posture in the user. The cushion comprises a unitary body formed of expanded polymeric foam and preferable a skin enclosing the foam.

The characteristics of the foam are important and are discussed below. The skin may be formed as a part of the molding process in the formation of the body or added thereafter as a coating or by solvent or heat softening of the outer surfaces of the foam. In the preferred embodiment, a skin, which is desired but optional, is formed when the pillow is formed by expanding polymer in a mold.

The cushion is generally rectangular when viewed from the top in its use position, as in FIG. 1. Reference is made now to FIGS. 2 through 5 which depict in somewhat greater detail various surfaces of cushion and the cross-sectional features thereof. The cushion comprises a generally rectangular fiat bottom cushion surface 102 for resting on and being support by a generally flat support surface. For example, the cushion 100 can be placed in a chair, on a bench, on a couch or automobile seat, etc. The support surface need only be generally fiat, i.e. the degree of flatness normally found in seats, couches, etc. In this respect, cushion is support in the same manner as is the case with most other cushions.

Figure 6:
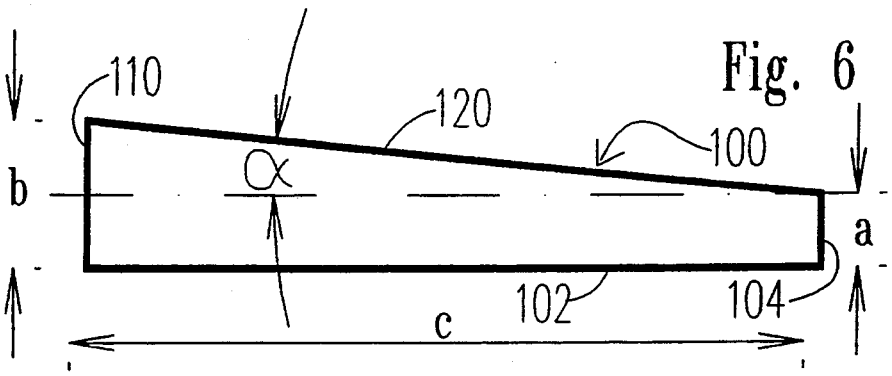
FIG. 6 is a schematic view of a cross section of the basic cushion, i.e. the upper and lower cushion surfaces and front and rear end provided to aid in understanding the dimensions of the cushion and the slope of the upper surface relative to the lower cushion surface.

A front side 104 extends generally perpendicularly upwardly from the bottom cushion surface. The degree of perpendicularly is not at all critical and it may be desired to slope the sides of the cushion, particularly the front side. In a somewhat similar manner, left and right sides 106, 108 extending generally perpendicularly upwardly from the bottom cushion surface, however, at least portions of left and right sides (104 and 108) comprise generally triangular portions such that the upper surface of the cushion 120 lies generally in a plane that lies at an angle of about 5 degrees, plus or minus about two degrees, relative to the bottom cushion surface. The rear side 110 extends generally perpendicularly upwardly from the bottom cushion surface a distance of at least about one inch greater than the height of the front side, consistently with the requirement that the upper surface angular disposition relative to the lower cushion surface. Reference is made briefly to FIG. 6 for better understanding of this relationship. As will be seen the bottom surface 102 lies generally in a plane which, generally, in use will be horizontal to the earth's surface, whereas the upper surface 120 lies in a plane tilted forwardly from the back 110 to the front 104. The base thickness of the cushion a may be any thickness, but the back 110 is about one inch higher than the front 104 as shown at b such that the angle between the planes of the surfaces, is about $5\pm2$ degrees. Somewhat greater or lesser angles may be used but do not result in fully suitable cushions.

The upper surface 120 has front and rear edges corresponding generally to the top of the front and rear sides respectively and left and right edges, as viewed from the front, corresponding generally to the left and right sides respectively. The upper surface 120 is configured and adapted to receive and support the buttocks of the user when the user sits thereupon facing toward the front edge thereof. The upper surface is, in the preferred embodiment, so configured so as to comprise: a generally rectangular, generally planar area lying generally in a plane lying above and at an angle of about $5\pm2$ degrees.

The cushion and the upper surface have as the major dimension thereof a width from end to end of about one and one-fourth to about one and one-half feet and as the minor dimension thereof a depth of about one foot from front to back. The depth c is shown in FIG. 6 for reference.

Figure 7:
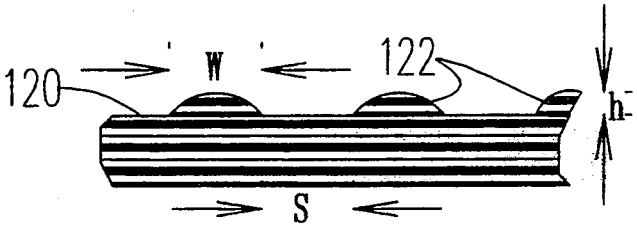
FIGS. 7, 8, 9 and 10 are enlarged cross-sectional views of portions of the cushion showing, respectively, in FIG. 7 the dimensions of the plurality of upward projections, in FIG. 8 the cross-sectional dimensions of the ridges, in FIG. 9 the dimensions of the depression in the rear of the cushion and in FIG. 10 the dimensions of the raised portion in the front of the cushion.

Continuing reference to FIGS. 1 through 5, and also to FIG. 7 briefly, the upper surface preferably has a multiplicity of upstanding projections 122 from said generally planar area. These projections are preferably generally spherically segmental in configuration; however, projections of virtually and configuration may be used. In the preferred embodiment, the projections 122 have a base width, W in FIG. 7, of from 0.7 to 1.2 inches in diameter and extend from about one-eighth inch to about one-half inch above said generally planar area, as shown at h in FIG. 7. The projections are preferably spaced from each other by distances of from about 1/16th inch to about 1 inch as shown at s in FIG. 7.

Figure 8:
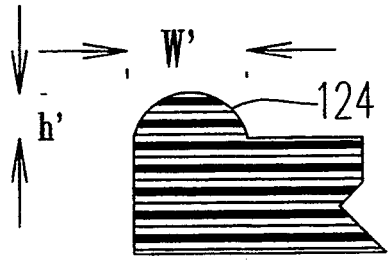

With continuing reference to FIGS. 1–5 and FIG. 8 now, it will be noted that the cushion body is so configured as to define a left ridge 124 extending upwardly from the left end of the planar area and from the left portion of the rear edge and a right ridge 126 extending upwardly from the right end of the planar area and from the right portion of the rear edge. The left and right ridges are preferably, but not necessarily, generally arcuate in cross-section, as shown in FIG. 8, which is typical of both ridges 124 and 126, as shown at h' in FIG. 8 extend from about one-fourth to about one-half inch above the planar area and have a diameter of from about one-half to about one-inch as shown at W' in FIG. 8.

Figure 9:
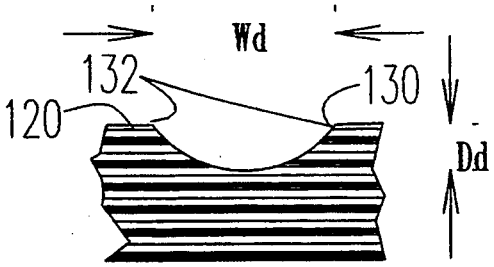
Figure 10:
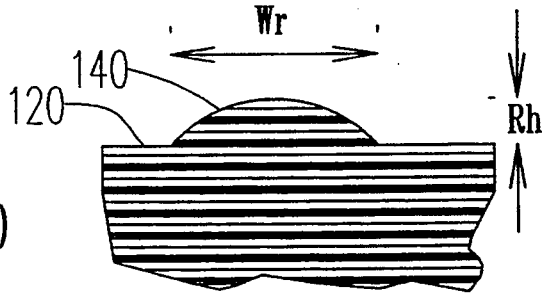

An important aspect of the invention is the definition by the cushion of a depression 130 in the central rear of the planar area of the cushion. As shown in FIGS. 1–5, and now making reference to FIG. 9, depression being generally in the configuration of a segment of a rounded apex frustocone wherein the apex is adjacent the center of the rectangular planar area and the base 132. As shown in FIG. 9, the base 132 has a diameter Wd of about two inches. The depression base of the depression is defined by the rear edge and rear side of the cushion with the rounded apex extending toward the center of the cushion. The depression is thereby so configured as to receive the coccyx of the user without exerting force on the same. The entire weight of the user is borne by the planar surface and the projections thereupon.

As an aid to convenience and comfort of the cushion, a raised general semi-frustoconical portion 140 generally is formed in the upper surface centrally located in the front edge of the cushion, the base 142 of the segment of a rounded apex frustocone having a diameter Wr of about three inches defined by the front edge and the apex extending toward the center of the rectangular planar area.

The compression characteristics of the cushion are important, but such characteristics may be achieved using many materials. The presently preferred material is a polyurethane famed robber composition. Foamed butyl rubber, silicone rubber, etc. may be used as well. Polyurethane is relatively inexpensive, and is easily formed into cushions having the desired compressional characteristics.

The foam of which the cushion is timed is compressible to a limited degree such that compression of the cushion while the lower cushion surface is generally uniformly supported on a generally flat support surface by the application one hundred pounds generally uniformly on the central seating area of the upper cushion surface by not less than one-fourth inch and not more than three-fourth inches; and compression of the cushion while the lower cushion surface is generally uniformly supported on a generally flat support surface by the application two hundred pounds generally uniformly on the central seating area of the upper cushion surface by not less than one-half inch and not more than one inch. If the foam is substantially more compressible, it has reduced and, ultimately, disappearing value in relieving pain in the user and in protecting the users coccyx.

It is recognized that the above definition of the characteristics of the foam body is unusual; however, it is the best definition known that takes into account the physiological and comfort requirements of the user. The use of percentage of compression is unsatisfactory because a very thick cushion with a low percentage compression would result in so much compression that force would be exerted on the coccyx and the effect of the projections would become insignificant.

The projections on the upper surface, shown in the example to be segments of spheres, may be in virtually an configuration, e.g. bars, segments of ellipses, etc., spaced no more than about an inch apart, are effective only if they bear the majority of the users weight. If the foam is too soft, or fairly firm but too deep, this result may not be accomplished.

The ridges around the edge on the ends of the cushion add stability to the configuration and greater comfort to the user. They may, however, be omitted without great detriment.

Within the general parameters described, a number of variations will be apparent to those skilled in the art.

INDUSTRIAL APPLICATION

This invention is used by individuals who suffer from poor circulation, who suffer from low back pain or an injured or painful coccyx, and to all who are required to sit for long periods of time.

What is claimed is:

1. An orthopedic seat cushion (100) for permitting free circulation, protecting the user's coccyx, reducing low back pain and promoting good posture, comprising a unitary body formed of expanded polymeric foam and a skin enclosing said foam, the body defining a (a) a generally rectangular flat bottom cushion surface (102) for resting on and being support by a generally flat support surface;

(b) a front side (104) extending upwardly from the bottom cushion surface;

(c) left and right sides (106, 108) extending upwardly from the bottom cushion surface, said left and right sides comprising generally triangular portions;

(d) a rear side (110) extending upwardly from the bottom cushion surface a distance of at least about one inch greater than the height of the front side, (b) an upper surface having front and rear edges corresponding generally to the top of the front and rear sides respectively, and left and right edges as viewed from the front, corresponding generally to the left and right sides respectively, the upper surface being configured and adapted to receive and support the buttocks of the user when the user sits thereupon facing toward the front edge thereof and being so configured so as to comprise:

(i) a generally rectangular, generally planar area (120) lying generally in a plane lying above and at an angle, of about 5±2 degrees with respect to the bottom cushion surface, said surface having as the major dimension thereof a width of about one and one-fourth to about one and one-half feet, and as the minor dimension thereof a depth of about one foot;

(ii) a multiplicity of upstanding projections (122) from said generally planar area said projections spaced from each other by distances of from about 1/16th inch to about 1 inch and extending from about one-eighth inch to about one-half inch above said generally planar area; and (iii) a depression (130) in the central rear of the planar area, said depression being generally in the configuration of a segment of a rounded apex frustocone wherein the apex is adjacent the center of the rectangular planar area and the base (132) has a diameter of about two inches defined by the rear edge and rear side of the cushion, the depression being so configured as to receive the coccyx of the user;

said foam being compressible to a limited degree such that (i) compression of the cushion while the lower cushion surface is generally uniformly supported on a generally flat support surface by the application one hundred pounds generally uniformly on the central seating area of the upper cushion surface by not less than one-fourth inch and not more than three-fourth inches;

(ii) compression of the cushion while the lower cushion surface is generally uniformly supported on a generally flat support surface by the application two hundred pounds generally uniformly on the central seating area of the upper cushion surface by not less than one-half inch and not more than one inch.

2. An orthopedic seat cushion (100) for permitting free circulation, protecting the user's cocci, reducing low back pain and promoting good posture, comprising a unitary body formed of expanded polymeric foam and a skin enclosing said foam, the body defining a (a) a generally rectangular flat bottom cushion surface (102) for resting on and being support by a generally flat support surface;

(b) a front side (104) extending upwardly from the bottom cushion surface:

(c) left and right sides (106, 108) extending upwardly from the bottom cushion surface, said left and right sides comprising generally triangular portions;

(d) a rear side (110) extending upwardly from the bottom cushion surface a distance of at least about one inch greater than the height of the front side;

(b) an upper surface having front and rear edges corresponding generally to the top of the front and rear sides respectively, and left and right edges as viewed from the front, corresponding generally to the left and right sides respectively, the upper surface being configured and adapted to receive and support the buttocks of the user when the user sits thereupon facing toward the front edge thereof, and being so configured so as to comprise:

(i) a generally rectangular, generally planar area (120) lying generally in a plane lying above and at an angle, of about 5±2 degrees with respect to the bottom surface of the cushion, said upper surface having as the major dimension thereof a width of about one and one-fourth to about one and one-half feet, and as the minor dimension thereof a depth of about one foot;

(ii) a multiplicity of upstanding projections (122) from said generally planar area, said projections being generally spherically segmental in configuration, being spaced from each other by distances of from about 1/16th inch to about 1 inch, having a base of from 0.7 to 1.2 inches in diameter and extending from about one-eighth inch to about one-half inch above said generally planar area;

(iii) a depression (130) in the central rear of the planar area, said depression being generally in the configuration of a segment of a rounded apex frustocone wherein the apex is adjacent the center of the rectangular planar area and the base (132) has a diameter of about two inches defined by the rear edge and rear side of the cushion, the depression being so configured as to receive the coccyx of the user; and (iv) a raised general semi-frustoconical portion (140) generally centrally located in the front edge of the cushion, the front edge of the base (142) of the segment of a rounded apex frustocone having a diameter of about three inches defined by the front edge and the apex extending toward the center of the rectangular planar area;

said foam being compressible to a limited degree such that (i) compression of the cushion while the lower cushion surface is generally uniformly supported on a generally flat support surface by the application one hundred pounds generally uniformly on the central seating area of the upper cushion surface by not less than one-fourth inch and not more than three-fourth inches;

(ii) compression of the cushion while the lower cushion surface is generally uniformly supported on a generally flat support surface by the application two hundred pounds generally uniformly on the central seating area of the upper cushion surface by not less than one-half inch and not more than one inch.

3. An orthopedic seat cushion (100) for permitting free circulation, protecting the user's coccyx, reducing low back pain and promoting good posture, comprising a unitary body formed of expanded polymeric foam and a skin enclosing said foam, the body defining a (a) a generally rectangular flat bottom cushion surface (102) for resting on and being support by a generally flat support surface;

(b) a front side (104) extending generally perpendicularly upwardly from the bottom cushion surface;

(c) left and right sides (106, 108) extending generally perpendicularly upwardly from the bottom cushion surface, said left and right sides comprising generally triangular portions;

(d) a rear side (110) extending generally perpendicularly upwardly from the bottom cushion surface a distance of at least about one inch greater than the height of the front side;

(b) an upper surface having front and rear edges corresponding generally to the top of the front and rear sides respectively, and left and right edges as viewed from the front, corresponding generally to the left and right sides respectively, the upper surface being configured and adapted to receive and support the buttocks of the user when the user sits thereupon facing toward the front edge thereof, and being so configured so as to comprise:

(i) a generally rectangular, generally planar area (120) lying generally in a plane lying above and at an angle, of about 5±2 degrees, said surface having as the major dimension thereof a width of about one and one-fourth to about one and one-half feet, and as the minor dimension thereof a depth of about one foot;

(ii) a multiplicity of upstanding projections (122) from said generally planar area, said projections being generally spherically segmental in configuration, being spaced from each other by distances of from about 1/16th inch to about 1 inch, having a base of from 0.7 to 1.2 inches in diameter and extending from about one-eighth inch to about one-half inch above said generally planar area;

(iii) a left ridge (124) extending upwardly from the left end of the planar area and from the left portion of the rear edge;

(iv) a right ridge (126) extending upwardly from the right end of the planar area and from the right portion of the rear edge; said left and right ridges being generally arcuate in cross-section extending from about one fourth to about one-half inch above the planar area;

(v) a depression (130) in the central rear of the planar area, said depression being generally in file configuration of a segment of a rounded apex frustocone wherein the apex is adjacent the center of the rectangular planar area and the base (132) has a diameter of about two inches defined by the rear edge and rear side of the cushion, the depression being so configured as to receive the coccyx of the user; and (vi) a raised general semi-frustoconical portion (140) generally centrally located in the front edge of the cushion, the front edge of the base (142) of the segment of a rounded apex frustocone having a diameter of about three inches defined by the front edge and the apex extending toward the center of the rectangular planar area;

said foam being compressible to a limited degree such that (i) compression of the cushion while the lower cushion surface is generally uniformly supported on a generally flat support surface by the application one hundred pounds generally uniformly on the central seating area of the upper cushion surface by not less than one-fourth inch and not more than three-fourth inches;

(ii) compression of the cushion while the lower cushion surface is generally uniformly supported on a generally flat support surface by the application two hundred pounds generally uniformly on the central seating area of the upper cushion surface by not less than one-half inch and not more than one inch.

* * * * *